US009509049B2

(12) United States Patent
Yosui

(10) Patent No.: US 9,509,049 B2
(45) Date of Patent: Nov. 29, 2016

(54) MAGNETIC ANTENNA, ANTENNA DEVICE, AND ELECTRONIC APPARATUS

(71) Applicant: Murata Manufacturing Co., Ltd., Nagaokakyo-shi, Kyoto-fu (JP)

(72) Inventor: Kuniaki Yosui, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 240 days.

(21) Appl. No.: 14/220,156

(22) Filed: Mar. 20, 2014

(65) Prior Publication Data

US 2014/0203976 A1 Jul. 24, 2014

Related U.S. Application Data

(63) Continuation of application No. PCT/JP2012/083005, filed on Dec. 20, 2012.

(30) Foreign Application Priority Data

Dec. 22, 2011 (JP) ..... 2011-280651

(51) Int. Cl.

| | |
|---|---|
| ***H01Q 7/06*** | (2006.01) |
| ***H01Q 7/08*** | (2006.01) |
| *H01Q 1/24* | (2006.01) |
| *H01P 1/203* | (2006.01) |

(52) U.S. Cl.

CPC ..... *H01Q 7/06* (2013.01); *H01Q 7/08* (2013.01); *H01P 1/20345* (2013.01); *H01Q 1/243* (2013.01)

(58) Field of Classification Search

CPC ..... H01Q 7/06

USPC ..... 343/702, 788, 722

See application file for complete search history.

(56) References Cited

U.S. PATENT DOCUMENTS

| | | | | |
|---|---|---|---|---|
| 2009/0160719 | A1* | 6/2009 | Kato | G06K 19/07749 343/742 |
| 2011/0124299 | A1 | 5/2011 | Koujima et al. | |
| 2011/0227799 | A1 | 9/2011 | Hashimoto | |

(Continued)

FOREIGN PATENT DOCUMENTS

| | | | |
|---|---|---|---|
| CN | 101208830 | A | 6/2008 |
| CN | 102017302 | A | 4/2011 |

(Continued)

OTHER PUBLICATIONS

Official Communication issued in International Patent Application No. PCT/JP2012/083005, mailed on Mar. 19, 2013.

(Continued)

*Primary Examiner* — Dameon E Levi
*Assistant Examiner* — Andrea Lindgren Baltzell
(74) *Attorney, Agent, or Firm* — Keating & Bennett, LLP

(57) ABSTRACT

A magnetic antenna includes a plurality of magnetic layers, coil conductor patterns wound around the magnetic layers about a winding axis in a direction perpendicular or substantially perpendicular to a stacking direction of the magnetic layers, a dielectric layer stacked on an outer layer of the magnetic layers, and a conducting pattern provided with the dielectric layer and coupled with a ground. The conducting pattern and the coil conductor patterns disposed along the outer layer are arranged such that at least a portion of the coil conductor patterns faces the conducting pattern and defines a stray capacitor therewith.

20 Claims, 8 Drawing Sheets

(56) References Cited

U.S. PATENT DOCUMENTS

| | | | |
|---|---|---|---|
| 2012/0062436 | A1 | 3/2012 | Kimura et al. |
| 2012/0091210 | A1 | 4/2012 | Koujima et al. |

FOREIGN PATENT DOCUMENTS

| | | | |
|---|---|---|---|
| JP | 2007-019891 | A | 1/2007 |
| JP | 2008-301527 | A | 12/2008 |
| JP | 2010-259068 | A | 11/2010 |
| JP | 2011-024146 | A | 2/2011 |
| JP | 2011-199343 | A | 10/2011 |
| WO | 2011/010440 | A1 | 1/2011 |

OTHER PUBLICATIONS

Official Communication issued in corresponding Chinese Patent Application No. 201280035326.7, mailed on Sep. 25, 2014.

* cited by examiner

MAGNETIC ANTENNA, ANTENNA DEVICE, AND ELECTRONIC APPARATUS

BACKGROUND OF THE INVENTION

1. Field of the Invention

The present invention relates to a magnetic antenna formed by winding a coil conductor around a magnetic layer. The present invention also relates to an antenna device and an electronic apparatus.

2. Description of the Related Art

Japanese Unexamined Patent Application Publication No. 2007-19891 discloses a magnetic antenna formed by winding a coil conductor around a magnetic layer so that its winding axis direction and its layer-stacking direction are orthogonal to each other. In that magnetic antenna, an insulation layer is formed on the outmost layer of the magnetic layer to prevent the coil conductor from making contact with any external metal object. In this magnetic antenna, the insulation layer is provided with a conducting layer to prevent changes in characteristics of the magnetic antenna and shifting in resonant frequency when the magnetic antenna is brought close to a metal object.

When an antenna is used in an HF band, it is necessary to connect a low pass filter (LPF) to the antenna so as to cut harmonic components. Thus, it is also necessary to secure a mounting space on a substrate to mount the LPF. A magnetic antenna such as described in Japanese Unexamined Patent Application Publication No. 2007-19891 may reduce the mounting space of the magnetic antenna. However, it is still necessary to secure the mounting space of the LPF. Thus, in Japanese Unexamined Patent Application Publication No. 2007-19891, there is an issue that a reduction in size may be difficult to achieve for an apparatus on which the magnetic antenna is mounted.

SUMMARY OF THE INVENTION

Accordingly, preferred embodiments of the present invention provide an electronic apparatus, an antenna device, and a magnetic antenna, which conserve space in an apparatus on which a device is to be mounted.

A magnetic antenna according to a preferred embodiment of the present invention includes a magnetic layer; a coil conductor wound around the magnetic layer; a dielectric layer stacked on an outer layer of the magnetic layer; and a conductor pattern provided with the dielectric layer and coupled to a ground potential. Furthermore, the coil conductor has a winding axis that is parallel or substantially parallel to the conductor pattern, and at least a portion of the conductor pattern faces the coil conductor disposed along the outer layer of the magnetic layer and defines a stray capacitor.

In this structure, the stray capacitor is defined between the coil conductor and the conductor pattern. This makes it possible to provide a LPF including an inductor component of the coil conductor and a capacitor component defined by the stray capacitor. Accordingly, the magnetic antenna with the LPF is provided, and there is no need to secure additional space for the LPF. Thus, space-saving is achieved.

In a magnetic antenna according to a preferred embodiment of the present invention, a plurality of the conductor patterns may be provided with the dielectric layer.

In this structure, by providing the plurality of the conductor patterns, the capacitance value of the stray capacitor generated between the conductor pattern and the coil conductor may be adjusted.

In the magnetic antenna according to a preferred embodiment of the present invention, the dielectric layer may include a plurality of layers, and each of the plurality of the conductor patterns may be provided with a different layer of the plurality of layers.

This structure enables adjustment of the capacitance value of the stray capacitor generated between the coil conductor and the conductor pattern by adjusting the distance between the coil conductor and the conductor pattern.

The magnetic layer may include a plurality of layers.

In this way, the magnetic layer may be composed of a multi-layer structure including plural layers of magnetic sheets.

Alternatively, the magnetic antenna may further include an external connection pattern that is provided with a surface of the dielectric layer and coupled to the ground potential, and a via conductor formed in the dielectric layer to provide electrical continuity between the conductor pattern and the external connection pattern.

In this structure, the conductor pattern is coupled to the ground potential through the via conductor and the external connection pattern. This facilitates the formation of a routing wiring path from the conductor pattern to the ground potential.

According to various preferred embodiments of the present invention, a stray capacitor is generated between the coil conductor and the conductor pattern, which makes it possible to provide a LPF that includes an inductor component of the coil conductor and a capacitor component defined by the stray capacitor. Accordingly, the magnetic antenna is provided with the LPF, and there is no need to secure additional space for the LPF. Thus, space-saving is achieved.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred Embodiment 1

Figure 1:
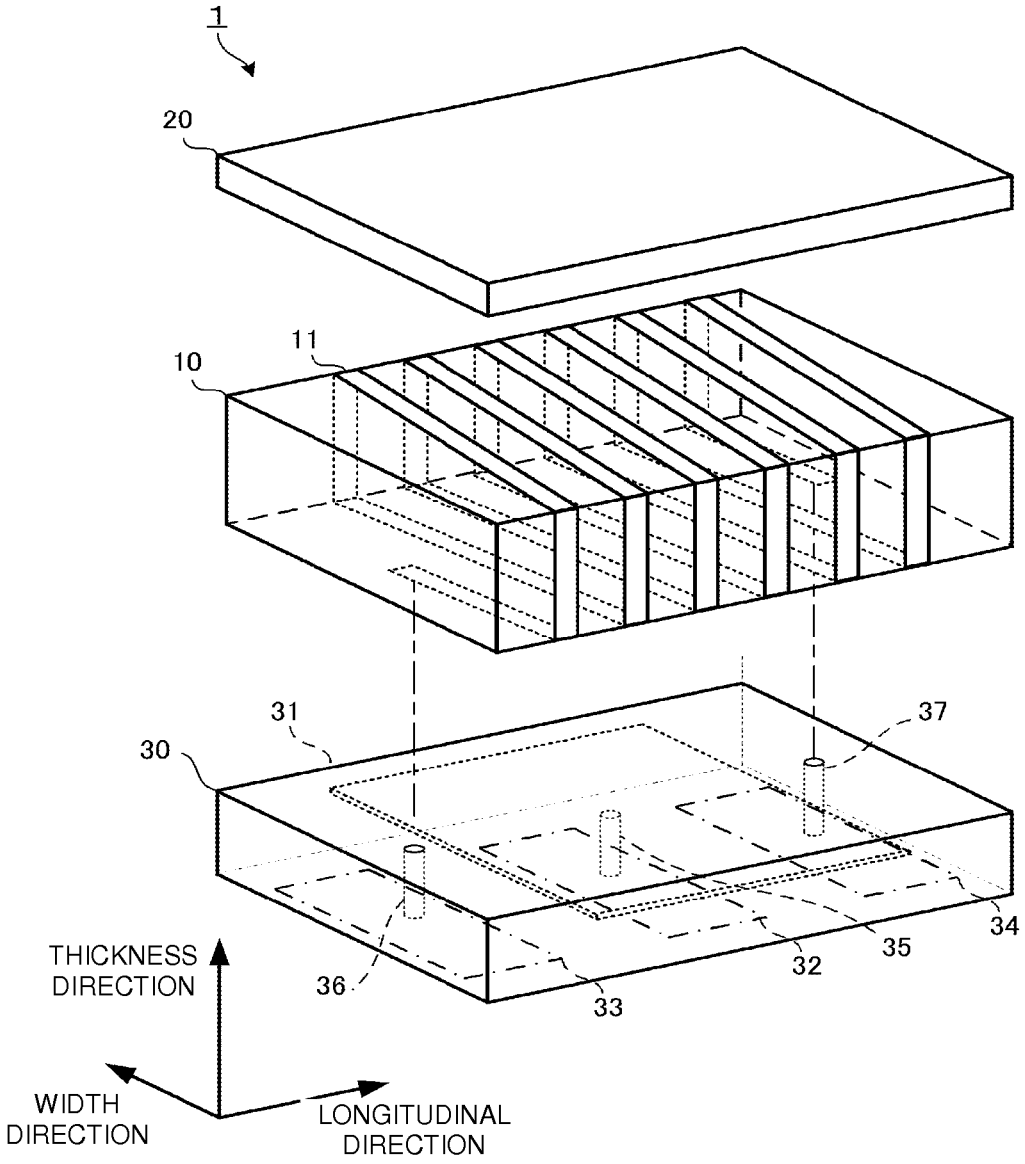
FIG. 1 is an exploded perspective view of a magnetic antenna according to Preferred Embodiment 1 of the present invention.
Figure 2:
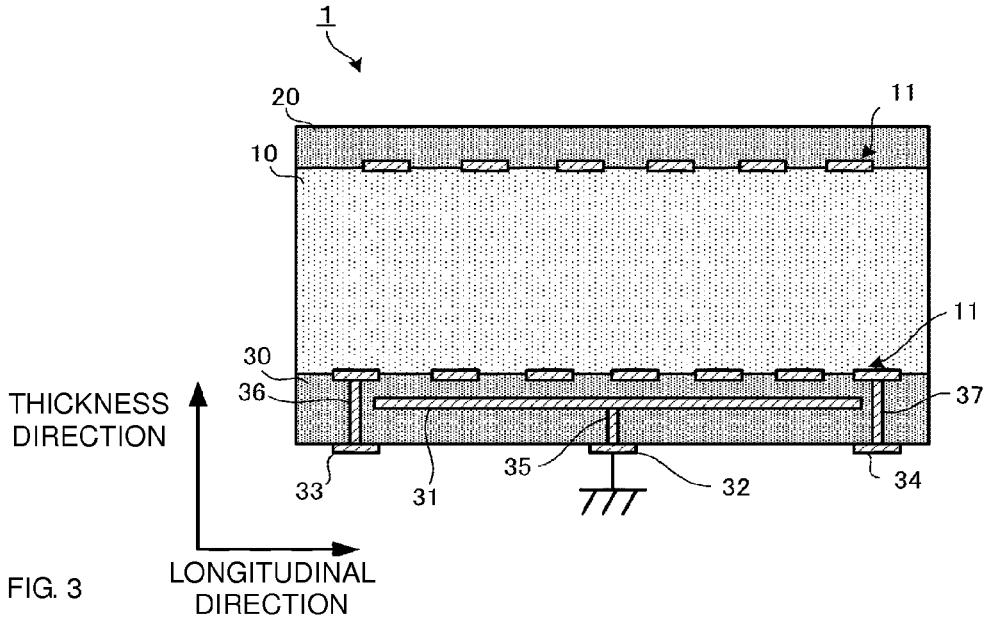
FIG. 2 is a side cross-section view of the magnetic antenna according to Preferred Embodiment 1 of the present invention.

FIG. 1 is an exploded perspective view of a magnetic antenna according to Preferred Embodiment 1 of the present invention. FIG. 2 is a side cross-section view of the magnetic antenna according to Preferred Embodiment 1.

The magnetic antenna 1 is preferably formed by stacking a magnetic layer 10 and dielectric layers 20, 30. The magnetic layer 10 and the dielectric layers 20, 30 respectively have rectangular or substantially rectangular solid shapes extending in their longitudinal directions, for example. The magnetic layer 10 is interposed between the dielectric layers 20 and 30. Hereinafter, the stacking direction of the magnetic layer 10 and the dielectric layers 20, 30 is referred to as a thickness direction of the magnetic antenna 1. Here, the dielectric layer 20 side is referred to as the upper side of the thickness direction, and the dielectric layer 30 side is referred to as the lower side thereof. Furthermore, the direction perpendicular or substantially perpendicular to the longitudinal direction and the thickness direction is referred to as a width direction of the magnetic antenna 1.

The magnetic layer 10 includes plural layers of rectangular or substantially rectangular magnetic sheets extending in the longitudinal direction. The magnetic material may contain, for example, a ceramic material and ferrite containing nickel, zinc, and copper, as primary components. Coil conductor patterns 11 are arranged on the magnetic layer 10 so as to define a spiral that coils along a top surface and a bottom surface (exterior layers) and two side surfaces extending in parallel or substantially in parallel to the longitudinal direction. The coil conductor patterns 11 have a winding axis parallel or substantially parallel to a conducting pattern 31. The coil conductor patterns 11 may be composed of, for example, Ag. More specifically, the coil conductor patterns 11 on the top surface and the bottom surface are preferably formed by printing and sintering metal paste containing Ag as a primary component on the surface of the magnetic sheets. Furthermore, the coil conductor patterns 11 on the two side surfaces may be composed of, for example, portions of via conductors that are formed by first forming the via conductors penetrating through the magnetic sheets and then cutting those via conductors. End portions of the coil conductor patterns 11 are arranged on the bottom surface of the magnetic layer 10.

The dielectric layer 20 and the dielectric layer may contain, for example, ceramic materials as their primary components. The dielectric layer 20 preferably includes a single layer and is disposed on the top surface side of the magnetic layer 10. The dielectric layer 30 preferably includes plural layers (plural dielectric sheets) arranged to have the conducting pattern 31 between those plural layers. The dielectric layer 30 is disposed on the bottom side of the magnetic layer 10. The coil conductor patterns 11 are exposed at the top surface and the bottom surface of the magnetic layer 10. Thus, the dielectric layers 20 and 30 located on the top surface and the bottom surface of the magnetic layer 10 prevent the coil conductor patterns 11 from making contact with any external conductor or dielectric object. It should be noted that, in the present invention, it is not always necessary to have the dielectric layer 20 on the top surface of the magnetic layer 10 in the magnetic antenna 1.

The conducting pattern 31 composed of Ag is provided inside the dielectric layer 30. The conducting pattern 31 is arranged so as to face at least a portion of the coil conductor patterns 11 located on the bottom surface of the magnetic layer 10 with gap therebetween. The conducting pattern 31 and the coil conductor patterns 11 generate a stray capacitor therebetween. In the present preferred embodiment, the conducting pattern 31 is preferably arranged to face substantially all the coil conductor patterns 11 located on the bottom surface of the magnetic layer 10.

External connection patterns 32, 33, and 34 for external connection are located on the bottom surface of the dielectric layer 30. The external connection pattern 32 is a ground connection terminal. The external connection patterns 33 and 34 are connection terminals for another circuit (for example, a signal amplifier circuit). The external connection patterns 32, 33, and 34 are arranged so as not to contact to each other.

A via conductor 35 is provided in the dielectric layer 30 between the conducting pattern 31 and the external connection pattern 32 in the thickness direction so as to provide electrical continuity between the conducting pattern and the external connection pattern 32. A ground potential is applied to the external connection pattern 32 so as to couple the conducting pattern 31 to the ground potential.

Furthermore, via conductors 36 and 37 are arranged in the thickness direction between the top surface of the dielectric layer 30 and the external connection patterns 33 and 34, respectively. Upper end portions of the via conductors 36 and 37 are exposed at the top surface of the dielectric layer 30, and provide electrical continuity with the respective end portions (two end portions of the coil antenna) of the coil conductor patterns 11, which are arranged on the bottom surface of the magnetic layer 10. Furthermore, lower end portions of the via conductors 36 and provide electrical continuity with the external connection patterns 33 and 34, respectively. In other words, the via conductors 36 and 37 provide electrical continuity between the coil conductor patterns 11 and the external connection patterns 33 and 34, and the external connection patterns 33 and 34 serve as an input terminal and an output terminal of the coil antenna including the coil conductor patterns 11.

Figure 3:
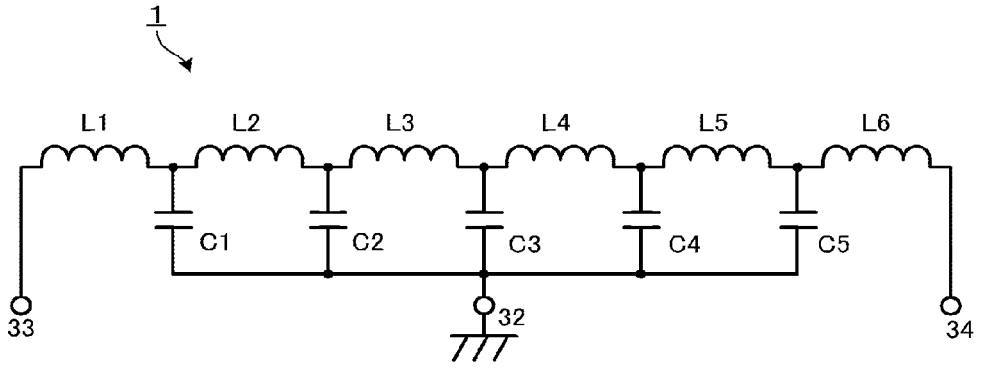
FIG. 3 is an equivalent circuit diagram of the magnetic antenna according to Preferred Embodiment 1 of the present invention.

FIG. 3 is an equivalent circuit diagram of the magnetic antenna 1 according to Preferred Embodiment 1. Inductors L1, L2, L3, L4, L5, and L6 in FIG. 3 are inductor components defined by the respective coil conductor patterns 11. Capacitors C1, C2, C3, C4, and C5 are stray capacitors formed between the respective coil conductor patterns 11 and the conducting pattern 31. In the present preferred embodiment, the conducting pattern 31 faces substantially all the coil conductor patterns 11 located on the bottom surface of the magnetic layer 10. Accordingly, a stray capacitor thus formed (total capacitance of the capacitors C1, C2, C3, C4, and C5) may be made larger.

As illustrated in FIG. 3, the magnetic antenna 1 acts as a multi-stage LC low pass filter with the inductors L1, L2, L3, L4, L5, L6 that are connected in series and the capacitors C1, C2, C3, C4, C5 that are coupled to ground. Accordingly, the magnetic antenna 1 is capable of attenuating harmonic components (frequency components of second harmonic, third harmonic, etc. of basic wave) of an input signal, thus making it possible to prevent or reduce radiation of the harmonic components as noise. Accordingly, noise transmission to a communication antenna of another system (for example, in UHF band) and the like is reduced. Furthermore, the magnetic antenna 1 according to the present preferred embodiment allows a single device to constitute and define both the coil antenna and the LPF. Accordingly, space-saving is achieved in an apparatus or the like, on which the magnetic antenna 1 is to be mounted.

Furthermore, the inductor components of the coil conductor patterns 11 that serve as the coil antenna are used as the inductor components of the LPF. This eliminates need for an additional inductor and makes it possible to reduce the size and lower the profile of the magnetic antenna 1. Still further, the conducting pattern 31 may also be made to function as a shield electrode on the bottom surface side of the magnetic antenna 1. Accordingly, it is possible to provide the magnetic antenna with protection against external interference and preferable characteristics. In the present preferred embodiment, the magnetic layer 10 preferably includes plural layers of the magnetic sheets. Alternatively, the magnetic layer 10 may be defined by a single layer of magnetic sheet.

Preferred Embodiment 2

Next, Preferred Embodiment 2 of the present invention is described. An magnetic antenna according to Preferred Embodiment 2 is different from that of Preferred Embodiment 1 in that plural conducting patterns, which form stray capacitors with the coil conductor patterns 11, are provided in the dielectric layer 30. Below, the differences therebetween are described. The same reference numerals denote elements similar to those of Preferred Embodiment 1, and descriptions thereof are omitted.

Figure 4:
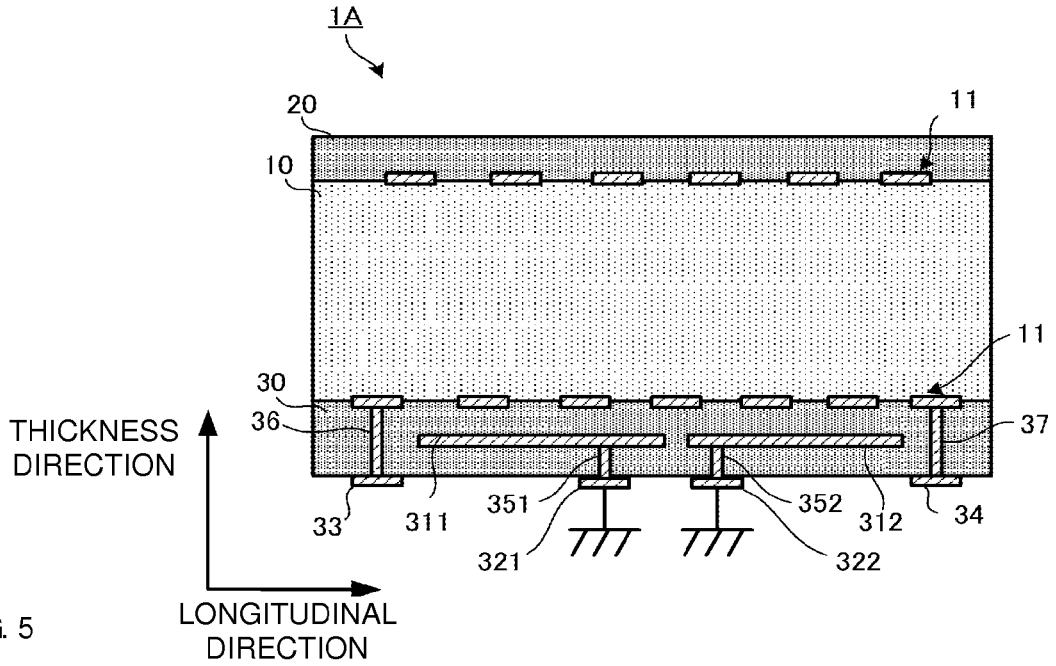
FIG. 4 is a side cross-section view of a magnetic antenna according to Preferred Embodiment 2 of the present invention.

FIG. 4 is a side cross-section view of the magnetic antenna according to Preferred Embodiment 2.

In the dielectric layer 30 of the magnetic antenna 1A, conducting patterns 311 and 312 are preferably provided on a same layer. External connection patterns 321 and 322 that serve as ground connection terminals are provided on the bottom surface of the dielectric layer 30. Furthermore, via conductors 351, 352 are formed in the dielectric layer 30 between the conducting patterns 311, 312 and the external connection patterns 321, 322 in the thickness direction to provide electrical continuity between the conducting patterns 311, 312 and the external connection patterns 321, 322, respectively.

As described above, the capacitance values of stray capacitors may be varied by forming the plural conducting patterns that define the stray capacitors with the coil conductor patterns 11 and changing the number of the coil conductor patterns 11 that face the respective conducting patterns 311 and 312. As a result, the pass band (frequency characteristics) of the LC low pass filter may be adjusted. Furthermore, the magnetic antenna 1A functions as the coil antenna and the LPF. Accordingly, space-saving is achieved in an apparatus or the like, on which the magnetic antenna 1A is to be mounted.

Furthermore, modification examples of the magnetic antenna 1 according to Preferred Embodiment 2 are described.

Figure 5:
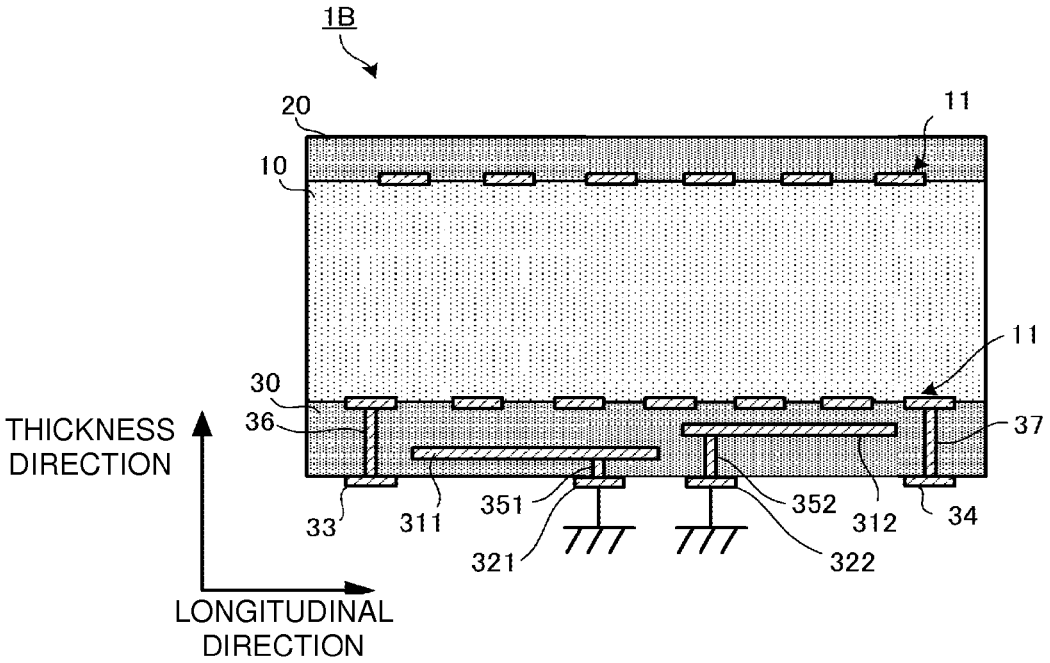
FIG. 5 is a view of a modification example of the magnetic antenna illustrated in FIG. 4.
Figure 6:
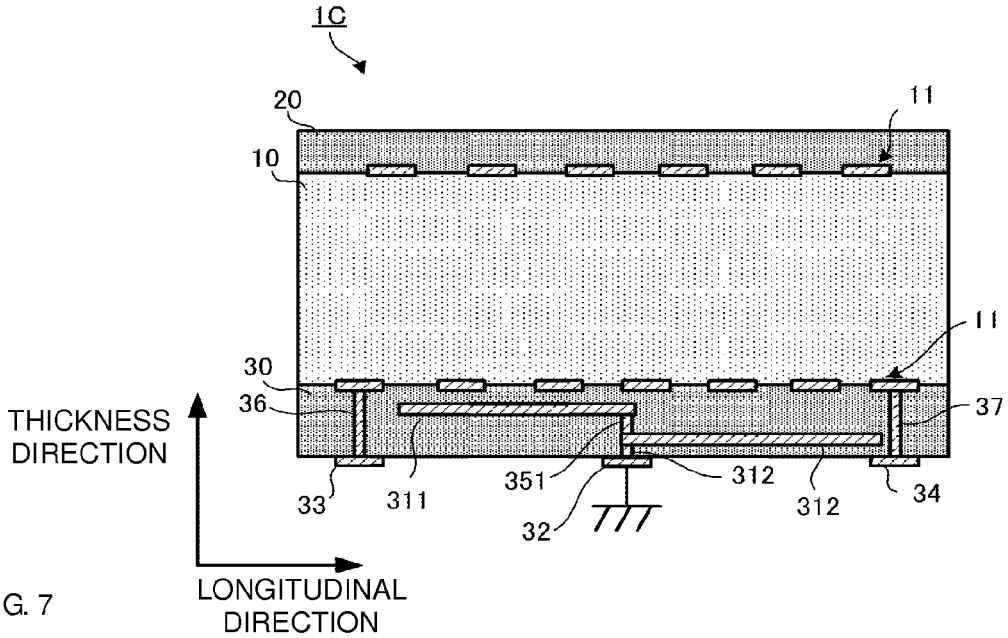
FIG. 6 is a view of a modification example of the magnetic antenna illustrated in FIG. 4.

FIG. 5 and FIG. 6 are views of modification examples of the magnetic antenna 1A illustrated in FIG. 4. Conducting patterns 311 and 312 of a magnetic antenna 1B illustrated in FIG. 5 may be provided on different layers of the dielectric layer 30. Furthermore, conducting patterns 311 and 312 of a magnetic antenna 1C illustrated in FIG. 6 may be provided on different layers of the dielectric layer 30, and portions of the conducting patterns 311 and 312 may overlap to each other in the thickness direction. In the case of structure illustrated in FIG. 6, a single via conductor 351 provides electrical continuity between the conducting patterns 311 and 312, and further with the external connection pattern 32. Accordingly, only a single piece of the external connection pattern 32 is required to define the ground connection terminal on the bottom surface of the dielectric layer 30.

According to the magnetic antennas 1B and 1C illustrated in FIG. 5 and FIG. 6, the conducting patterns 311 and 312 are preferably provided on different layers of the dielectric layer 30, thus making it possible to vary the capacitance value of stray capacitor generated between the coil conductor patterns 11 and the conducting pattern 311 and the capacitance value of stray capacitor generated between the coil conductor patterns 11 and the conducting pattern 312. This makes it possible to adjust the pass band (frequency characteristics) of LC low pass filter. Even with the structures illustrated in FIG. 5 and FIG. 6, space-saving is achieved in an apparatus or the like, on which the magnetic antenna 1 is to be mounted, and frequency characteristics of the magnetic antenna 1 may be adjusted.

Preferred Embodiment 3

In Preferred Embodiment 3 of the present invention, an antenna device including the magnetic antenna according to Preferred Embodiment 1 or 2 is described.

The antenna 1 device according to the present preferred embodiment may be, for example, for use in a reader-writer utilized in a HF band radio frequency identification (RFID) system such as near field communication (NFC) or the like. The HF band RFID system is a system that allows the reader-writer to communicate with a RFID tag by non-contact method and that transmits information between the reader-writer and the RFID using, for example, 13.56 MHz band as a communication frequency. The antenna device of the reader-writer transmits and receives predetermined information by coupling an antenna device of the RFID tag primarily through an induction field.

Figure 7:
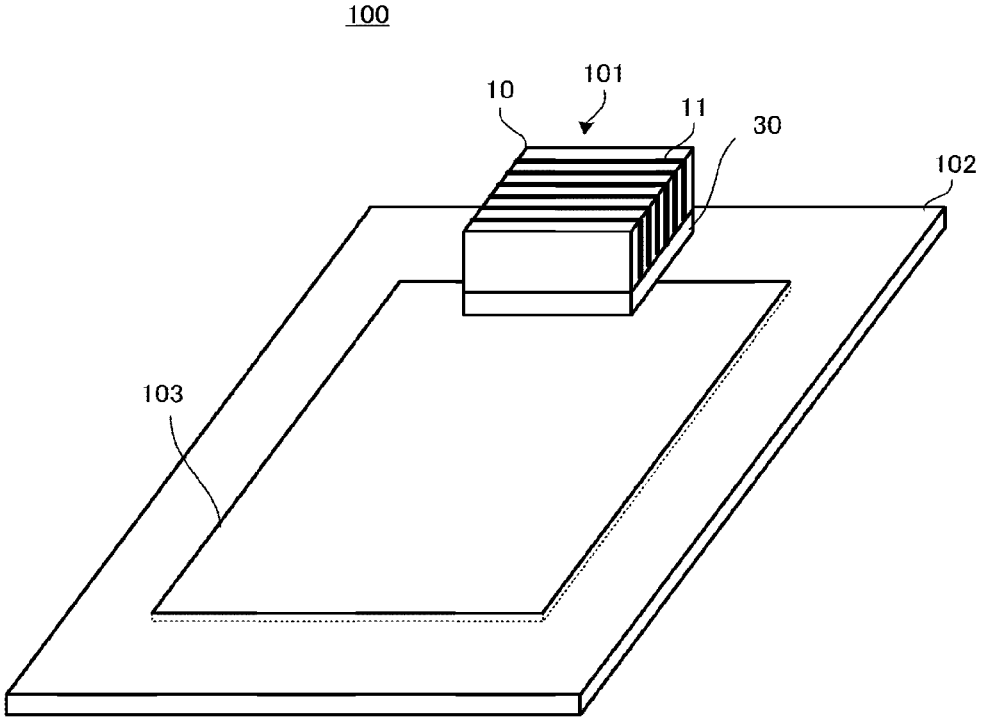
FIG. 7 is a perspective view of an antenna device according to Preferred Embodiment 3 of the present invention.
Figure 8:
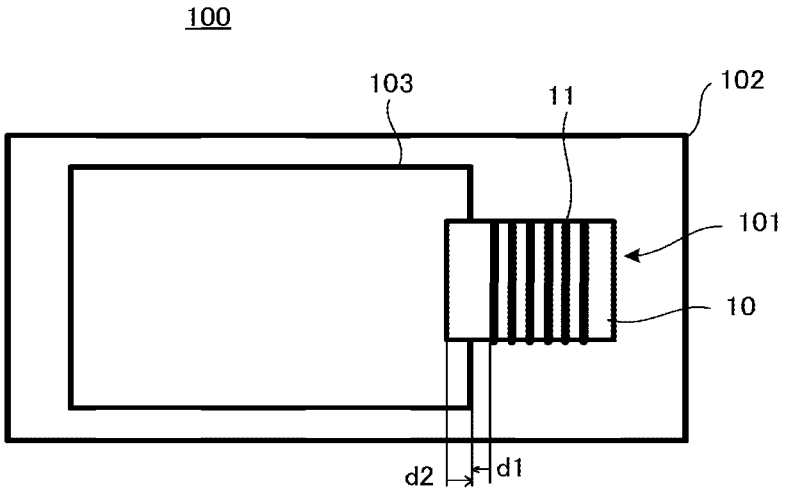
FIG. 8 is a top view of the antenna device according to Preferred Embodiment 3 of the present invention.
Figure 9:
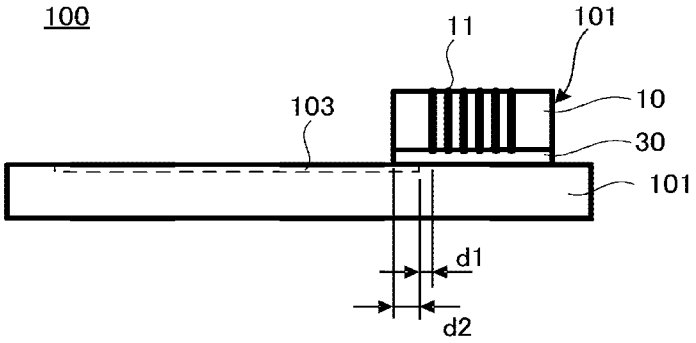
FIG. 9 is a front view of the antenna device according to Preferred Embodiment 3 of the present invention.

FIG. 7 is a perspective view of an antenna device according to Preferred Embodiment 3. FIG. 8 is a top view of the antenna device according to Preferred Embodiment 3. FIG. 9 is a front view of the antenna device according to Preferred Embodiment 3.

The antenna device 100 includes a coil antenna 101. The coil antenna 101 includes the magnetic antenna according to Preferred Embodiments 1 or 2. In the coil antenna 101, a coil conductor (coil conductor patterns 11) is wound around a magnetic core (magnetic layer 10). The dielectric layer 30 is stacked below the magnetic layer 10. It should be noted that the coil antenna 101 according to the present preferred embodiment preferably uses a magnetic antenna without the dielectric layer 20 described in Preferred Embodiments 1 and 2.

The antenna device 100 includes a base material 102 on which the coil antenna 101 is mounted and a plane conductor 103 provided on the base material 102. The base material 102 is composed of flexible resin. The plane conductor 103 is composed of a metal foil or a metal film of copper, silver, aluminum, or the like.

The coil antenna 101 and the plane conductor 103 are arranged so as to have a spatial relationship such that a coil opening portion of the coil conductor of the coil antenna 101 is located adjacent to (close to) an outer edge portion of the plane conductor 103. Furthermore, as illustrated in FIG. 8, the coil conductor patterns 11 and the plane conductor 103 are arranged in such a way that at least a portion of the coil conductor patterns 11 overlaps an edge portion of the plane conductor 103 in the coil antenna 101 when viewed in a direction normal to the plane conductor 103.

Here, it is preferable to satisfy $0<d2$ where d2 is the distance from an end surface of the magnetic core (magnetic layer 10) positioned inside the plane conductor 103 to the outer edge of the plane conductor 103, and d1 is the distance from an end part of the region, across which the coil conductor (coil conductor patterns 11) is wound, on the plane conductor 103 side to the outer edge of the plane conductor 103. When d1 is smaller or d2 is larger, coupling between the coil conductor and the plane conductor 103 becomes stronger, or the induction current increases. This produces an effect such that a larger magnetic flux is induced from the plane conductor 103.

Figure 10:
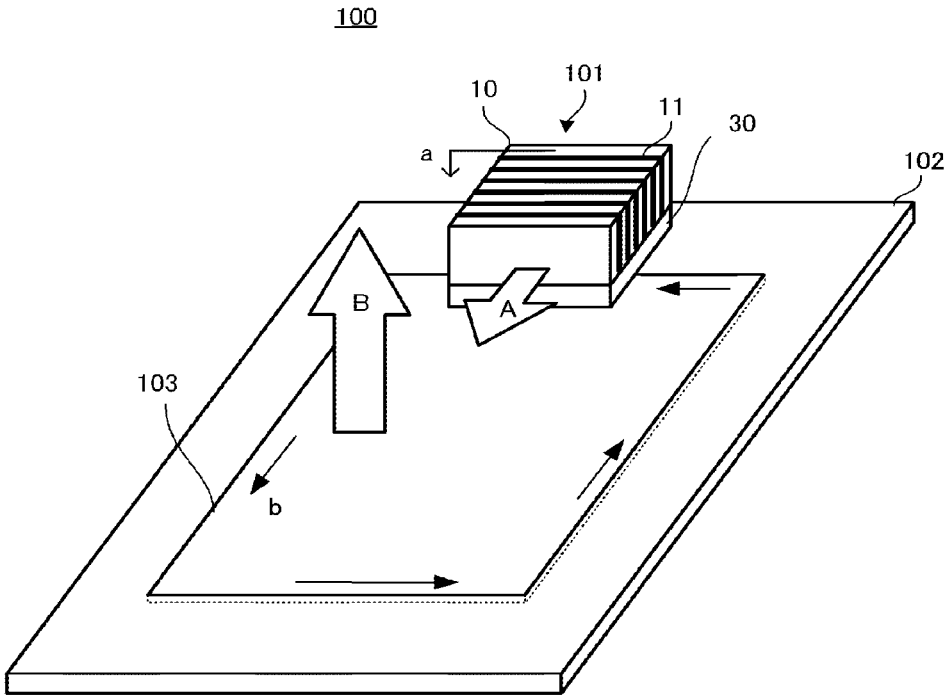
FIG. 10 is a perspective view illustrating respective directions of a current flowing through a coil conductor of a coil antenna of an antenna device, a current flowing through a plane conductor, a magnetic field induced by the coil antenna, and a magnetic field induced by the plane conductor.

FIG. 10 is a perspective view illustrating respective directions of a current flowing through the coil conductor of the coil antenna 101 of the antenna device 100, a current flowing through the plane conductor 103, a magnetic field induced by the coil antenna 101, and a magnetic field induced by the plane conductor 103. When a power supply circuit not shown in FIG. 10 supplies a current to the coil antenna 101, and a current "a" flows through the coil conductor, a current "b" is induced in the plane conductor 103 by the electromagnetic field induced by the current "a". As a result, a magnetic field along an arrow A direction is induced in the coil antenna 101, and a magnetic field along an arrow B direction is induced in the plane conductor 103. When a magnetic flux from a RFID tag that serves as a communicating party is received, the converse phenomena take place. In other words, the plane conductor 103 may function as a booster antenna and produce a magnetic field larger than the one produced solely by the coil antenna 101. It should be noted that the coil antenna 101 and the plane conductor 103 may not always necessarily overlap to each other as long as the plane conductor and the coil conductor are arranged close to each other so that the current is induced therebetween.

By using the magnetic antenna according to a preferred embodiment of the present invention in the antenna device 100 that functions as the booster antenna, the antenna device 100 is capable of reducing harmonic noise radiation without having an additional LPF. Accordingly, there is no need to secure additional space for mounting the LPF.

Figure 11A:
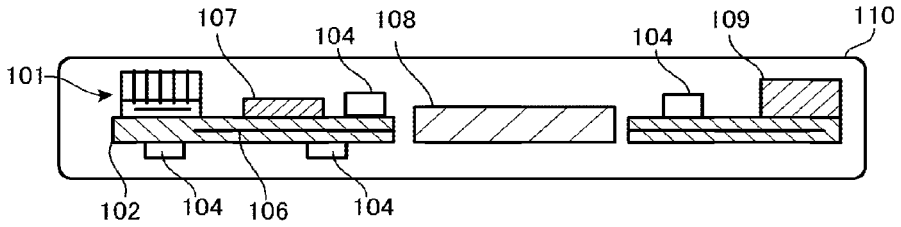
FIG. 11A is a side cross-section view of a cellular phone including the antenna device according to Preferred Embodiment 3 of the present invention.
Figure 11B:
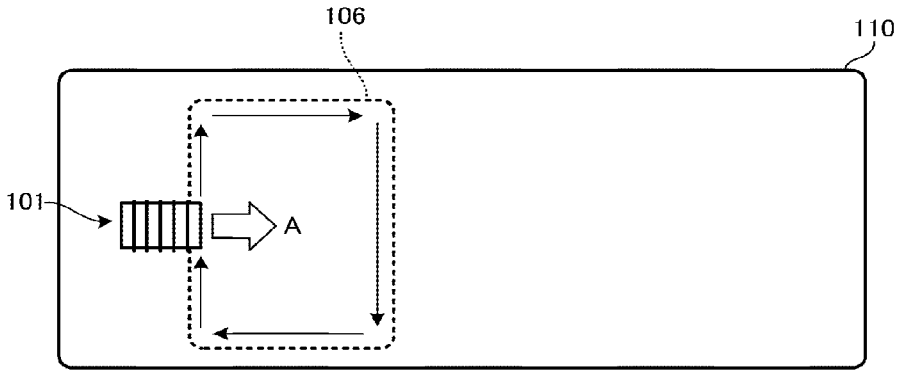
FIG. 11B is a top transparent view of the cellular phone including the antenna device according to Preferred Embodiment 3 of the present invention.

Below, a specific example of an electronic apparatus including the antenna device 100 according to Preferred Embodiment 3 is described. In the present preferred embodiment, the electronic apparatus preferably is a cellular phone, for example. FIG. 11A is a side cross-section view of the cellular phone including the antenna device 100 according to Preferred Embodiment 3. FIG. 11B is a top transparent view of the cellular phone.

The cellular phone 110 includes a base material 102 on which the foregoing coil antenna 101 is mounted and a battery 108. The base material 102 is a printed circuit board. On a mounting surface of the base material 102, a RFID IC chip 107 and a UHF band communication antenna 109 are also mounted as well. The coil antenna 101 is connected to the RFID IC chip 107 and functions as an antenna of the RFID IC chip 107. Furthermore, a plurality of electronic components 104 that serves as other components of the cellular phone 110 are mounted on both mounting surfaces of the base material 102. The electronic components 104 may be, for example, a chip capacitor, a chip coil, a resistor, an IC chip, etc. Furthermore, a ground conductor pattern 106 is located in between inner layers of the base material 102. The ground conductor pattern 106 replaces the plane conductor 103 described with reference to FIG. 7 and so on. More specifically, when a current flows through the coil antenna 101, this current induces an electromagnetic field, and then this electromagnetic field induces a current in an arrow direction illustrated in FIG. 11B in the ground conductor pattern 106. As a result, a magnetic field along an arrow A direction is induced in the coil antenna 101, and a magnetic field along a direction perpendicular or substantially perpendicular to the ground conductor pattern 106 (direction toward the top of page in FIG. 11A) is induced. When a magnetic flux from a RFID tag that serves as the communicating party is received, the converse phenomena take place.

Accordingly, no additional plane conductor is needed when the ground conductor pattern 106 is utilized as a radiation plate and the plane conductor 103 is not provided. Furthermore, since the harmonics outputted from the RFID IC chip 107 are removed by the magnetic antenna 1, influences to the communication antenna 109 or another peripheral device are prevented.

Preferred Embodiment 4

Figure 12A:
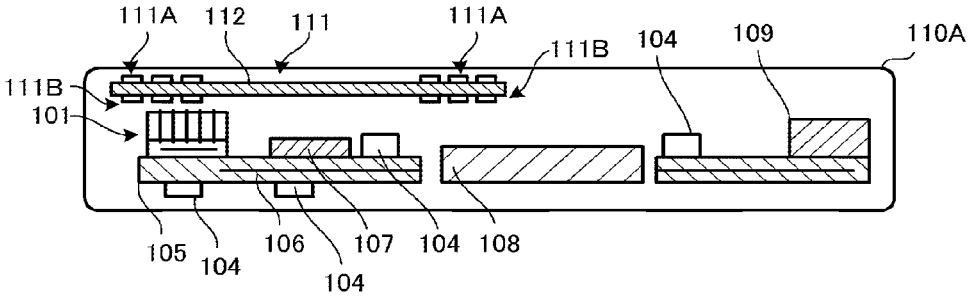
FIG. 12A is a side cross-section view of a cellular phone according to Preferred Embodiment 4 of the present invention.
Figure 12B:
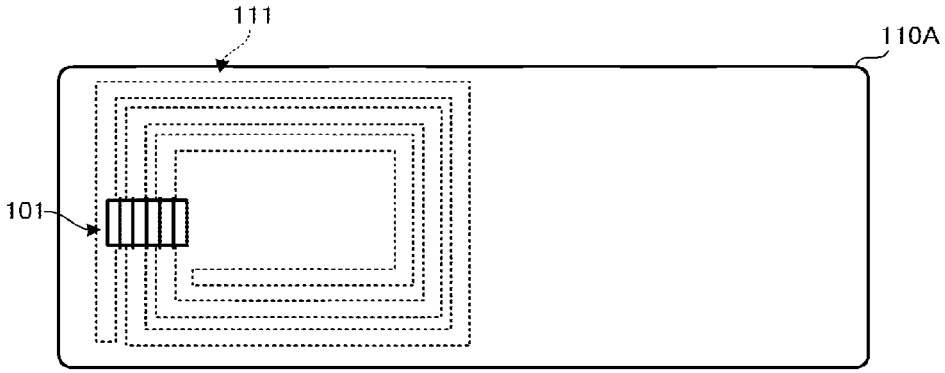
FIG. 12B is a top transparent view of the cellular phone according to Preferred Embodiment 4 of the present invention.

In Preferred Embodiment 4, a modification example of the cellular phone described in Preferred Embodiment 3 is described. The modification example is structured such that the cellular phone is provided with a booster antenna and that the antenna device includes this booster antenna. FIG. 12A is a side cross-section view of a cellular phone according to Preferred Embodiment 4. FIG. 12B is a top transparent view of the cellular phone.

As is the case with the cellular phone 110 according to Preferred Embodiment 3, the cellular phone 110A includes a base material 102 and a battery 108. On the base material 102, a UHF band communication antenna 109 and a RFID IC chip 107 are mounted in addition to a coil antenna 101.

Furthermore, the cellular phone 110A includes a casing in which a thin plate-shaped base material made of resign is used as a primary member. A booster antenna 111 is provided along the inner side of that casing. The booster antenna 111 may be fixed on the inner side of the casing with adhesive or the like, for example. The booster antenna 111 includes coil conductors wound about a winding axis along a direction normal to the principle surface (vertical direction to the principle surface) of the thin plate-shape base material 112. In the booster antenna 111, coil conductors 111A and 111B are respectively located on the top surface and the bottom surface of the thin plate-shaped base material 112 so as to face each other. The coil conductors 111A and 111B preferably have rectangular or substantially rectangular spiral shapes. The winding direction from an outer perimeter to an inner perimeter of the coil conductor 111A on the top surface is the same as the winding direction from an inner perimeter to an outer perimeter of the coil conductor 111B on the bottom surface.

The coil antenna 101 is magnetically coupled to the booster antenna 111. In other words, contactless transmissions of high frequency signal are carried out from the coil antenna 101 to the booster antenna 111 (or from the booster antenna 111 to the coil antenna 101) through magnetic coupling. The booster antenna 111 is sufficiently larger than the coil antenna 101 and facilitates communication with a communicating party side antenna. Accordingly, the communication with the communicating party side antenna may be primarily performed with the booster antenna 111. The coil antenna 101 is arranged close to the coil conductors of the booster antenna 111 in such a way that the winding axis of the coil conductor of the coil antenna 101 is perpendicular or substantially perpendicular to the winding axis of the coil conductor of the booster antenna 111.

Figure 13A:
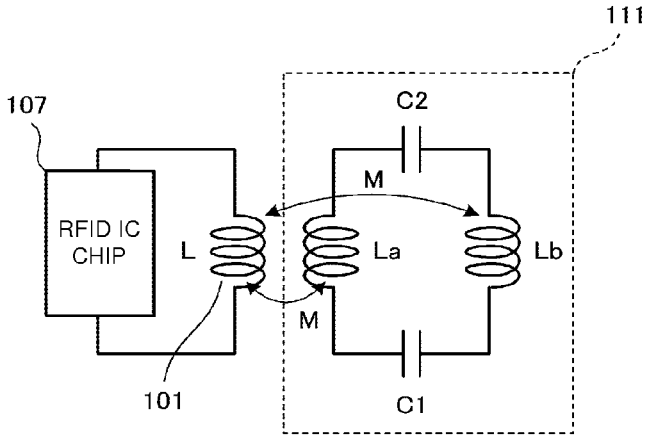
FIG. 13A is an equivalent circuit diagram of a circuit including a booster antenna and a coil antenna.
Figure 13B:
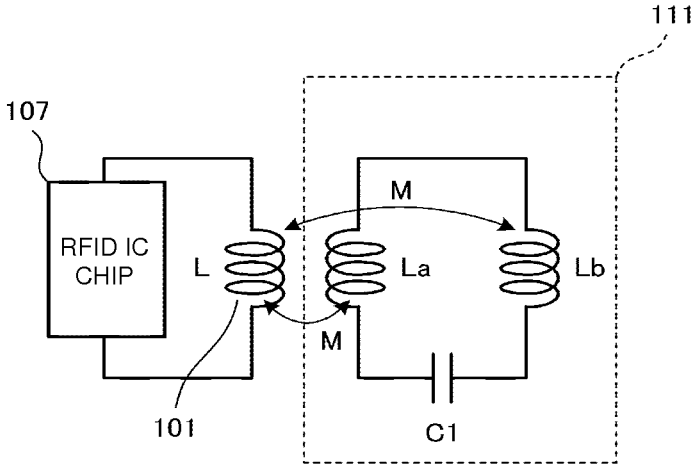
FIG. 13B is an equivalent circuit diagram of a circuit including a booster antenna and a coil antenna.

FIG. 13A and FIG. 13B are equivalent circuit diagrams of circuits including the booster antenna 111 and the coil antenna 101. In FIG. 13A, inductors La and Lb represent inductances produced by the coil conductors 111A and 111B illustrated in FIG. 13 with symbols. Capacitors C1 and C2 are capacitances produced between two ends of the coil conductor 111A and 111B (capacitances may be ones produced with capacitor devices or may be stray capacitors produced between facing portions of the coil conductors 111A and 111B), respectively. The inductors La, Lb and the capacitors C1, C2 define a LC resonance circuit. Symbol M represents coupling between an inductor L of the coil antenna 101 and the inductor La, Lb. Alternatively, as illustrated in FIG. 13B, one end of the coil conductor 111A may be directly connected to one end of the coil conductor 111B with a via conductor or the like.

As described above, the cellular phone 110A including the reader-writer to be used in a HF band RFID system may be realized by use of a magnetic antenna according to a preferred embodiment of the present invention. Furthermore, since the harmonics outputted from the RFID IC chip 107 are removed by the magnetic antenna 1, influences to the communication antenna 109 or another peripheral device are prevented.

It should be noted that designs of specific structures of the magnetic antenna and the like may be arbitrarily modified. Furthermore, the actions and effects described with the foregoing preferred embodiments are mere recitations of most preferable actions and effects that may be produced by the present invention, and the actions and effects of the present invention are not limited to those described with the foregoing preferred embodiments.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A magnetic antenna comprising:

a magnetic layer;

a coil conductor wound around the magnetic layer;

a dielectric layer stacked on an outer layer of the magnetic layer; and a conductor pattern provided with the dielectric layer and coupled to a ground potential; wherein the coil conductor has a winding axis that is parallel or substantially parallel to the conductor pattern;

at least a portion of the conductor pattern faces the coil conductor disposed along the outer layer of the magnetic layer and defines a stray capacitor; and a capacitance value of the stray capacitor is generated between the conductor pattern and the coil conductor.

2. The magnetic antenna according to claim 1, wherein a plurality of the conductor patterns is arranged along the dielectric layer.

3. The magnetic antenna according to claim 2, wherein the dielectric layer includes a plurality of layers; and each of the plurality of the conductor patterns is provided with a different layer of the plurality of layers.

4. The magnetic antenna according to claim 1, wherein the magnetic layer includes a plurality of layers.

5. The magnetic antenna according to claim 1, further comprising:

an external connection pattern located on a surface of the dielectric layer and coupled to the ground potential; and a via conductor arranged in the dielectric layer to provide electrical continuity between the conductor pattern and the external connection pattern.

6. The magnetic antenna according to claim 1, wherein the coil conductor pattern is wound around the magnetic layer to define a spiral that coils along a top surface and a bottom surface and two side surfaces of the magnetic layer.

7. The magnetic antenna according to claim 1, wherein the dielectric layer includes a plurality of layers arranged to sandwich the conductor pattern therebetween.

8. The magnetic antenna according to claim 1, wherein the dielectric layer includes a plurality of dielectric layers arranged to sandwich the magnetic layer therebetween, and a plurality of the conductor patterns are provided at an interface between one of the plurality of dielectric layers and an upper surface of the magnetic layer and between another one of the plurality of dielectric layers and a lower surface of the magnetic layer.

9. The magnetic antenna according to claim 1, wherein the coil conductor includes a plurality of coil conductor patterns located on a bottom surface of the magnetic layer, and the conducting pattern is arranged to face substantially all the coil conductor patterns.

10. The magnetic antenna according to claim 1, further comprising via conductors and external connection patterns that define an input terminal and an output terminal of the coil antenna, wherein the via conductors are arranged to provide electrical continuity between coil conductor patterns of the coil conductor and the external connection patterns.

11. The magnetic antenna according to claim 1, wherein the magnetic antenna defines both a coil antenna and a low pass filter.

12. The magnetic antenna according to claim 1, wherein the magnetic antenna defines a multi-stage LC low pass filter.

13. The magnetic antenna according to claim 1, wherein the dielectric layer includes a plurality of dielectric layers and a plurality of conductor patterns are located on different ones of the plurality of dielectric layers.

14. An antenna device comprising:

the magnetic antenna according to claim 1; and a plane conductor disposed close to the magnetic antenna and configured to function as a booster antenna.

15. The antenna device according to claim 14, wherein the antenna device defines both a coil antenna and a low pass filter.

16. The antenna device according to claim 14, wherein the antenna device defines a multi-stage LC low pass filter.

17. An electronic apparatus comprising:

the magnetic antenna according to claim 14;

a casing including the magnetic antenna therein; and a plane conductor provided with the casing; wherein the plane conductor is disposed close to the magnetic antenna and defines a booster antenna for the magnetic antenna.

18. The electronic apparatus according to claim 17, wherein the magnetic antenna defines both a coil antenna and a low pass filter.

19. The electronic apparatus according to claim 17, wherein the magnetic antenna defines a multi-stage LC low pass filter.

20. The electronic apparatus according to claim 19, wherein the electronic apparatus is a cellular phone.

* * * * *